US006526883B2

(12) United States Patent
Steffens et al.

(10) Patent No.: US 6,526,883 B2
(45) Date of Patent: Mar. 4, 2003

(54) MULTICOLOR INK TRANSFER ARRANGEMENT AND METHOD

(75) Inventors: Robert S. Steffens, Pepack, NJ (US); Alfred F. Schwenzer, Totowa, NJ (US)

(73) Assignee: Cronite Company Inc., Parsippany, NJ (US)

( * ) Notice: Subject to any disclaimer, the term of this patent is extended or adjusted under 35 U.S.C. 154(b) by 0 days.

(21) Appl. No.: 09/849,638

(22) Filed: May 4, 2001

(65) Prior Publication Data

US 2002/0162465 A1 Nov. 7, 2002

(51) Int. Cl.[7] ..... B41F 31/26; B41F 31/06
(52) U.S. Cl. ..... 101/350.1; 101/350.3
(58) Field of Search ..... 101/349, 350.1, 101/350.2, 350.3, 351.6, 186, 191, 192, 250, 348

(56) References Cited

U.S. PATENT DOCUMENTS 1,995,701 A * 3/1935 Buttner ..... 101/350.5
3,585,932 A * 6/1971 Granger ..... 101/169
3,837,275 A * 9/1974 Madsen ..... 101/207
4,165,688 A * 8/1979 Leanna et al. ..... 101/207
4,361,089 A * 11/1982 Wittkopf et al. ..... 101/182
5,722,324 A * 3/1998 Nishiwaki et al. ..... 101/363

* cited by examiner

*Primary Examiner*—Daniel J. Colilla
(74) *Attorney, Agent, or Firm*—Kirschstein, et al.

(57) ABSTRACT

Differently colored inks are applied in close proximity to each other during inking of an etched or engraved surface of a die or plate in a printing press. The spacing between the inks is controlled by the pressure of a transfer roller against the die or plate surface. The spacing can be reduced to effectively zero so that the inks effectively touch each other on the die or plate. Cross contamination of the inks when the transfer roller picks up the inks from a fountain roller is prevented.

13 Claims, 7 Drawing Sheets

80
78
76
82
76
72
74
72
70
42
48
62
58
52
44
104
74
68
54
24
12
60
67
56
62
16
46
66
64

MULTICOLOR INK TRANSFER ARRANGEMENT AND METHOD

BACKGROUND OF THE INVENTION

1. Field of the Invention

The present invention generally relates to an ink transfer arrangement for and method of transferring ink to an etched or engraved die or plate surface of a movable die or plate in a printing press, especially an intaglio or engraving press for producing engraved documents, such as securities or stationery, and, more particularly, to the transfer of differently colored inks in close proximity to each other during each inking of the die or plate surface.

2. Description of the Related Art

Intaglio printing on paper from an engraved plate was originally performed by a manually operated plate press. Thereupon, motor driven die stamping and embossing presses were developed for faster printing. Typically, an ink transfer arrangement in the motor driven press included an ink fountain pan for containing a supply of ink, a fountain roller partially immersed in the ink, and a transfer roller for picking up ink from the fountain roller and depositing the picked-up ink over the engraved or etched die or plate surface to be inked. The deposited ink is then wiped off the die or plate surface, leaving ink in the lines or grooves etched or engraved below the die or plate surface. The so treated surface is then pressed against sheet material such as paper to produce an engraved document. Reference can be had to U.S. Pat. No. 4,669,379 for details of an intaglio printing press.

Typically, an ink fountain pan contains ink of a single color. When multicolored engraved documents are desired, it is common to perform multiple passes of the paper through the press, each pass being made with a differently colored ink, thereby requiring perfect registration and positioning of each colored ink, in its turn, during separate ink transfer operations. Such separate operations limit the maximum production speed. Faster printing speeds were a primary consideration in the development of thermography.

Ink fountain pans having multiple differently colored ink supplies have been proposed. However, the differently colored inks were separated well apart, on the order of ¾ of an inch, in order to prevent the inks from mixing and contaminating each other. Such large separations, however, were impractical where differently colored engravings were required to be positioned close together, for example, on the same line, or where the document was relatively small, for example, a business card.

SUMMARY OF THE INVENTION

Objects of the Invention

Accordingly, it is a general object of this invention to transfer differently colored inks in close proximity to each other over an etched or engraved die or plate surface.

More particularly, it is an object of the present invention to increase the maximum printing speeds of die presses for producing multicolored engravings.

Still another object of the present invention is to control the spacing between differently colored inks deposited over a die or plate surface.

Features of the Invention

In keeping with the above objects and others which will become apparent hereafter, one feature of the present invention resides, briefly stated, in an ink transfer arrangement for, and method of, transferring differently colored inks to an etched or engraved work surface of a movable die or plate in a printing press. The invention includes an ink fountain pan mounted on the press. At least one partition divides the fountain into a plurality of compartments each containing a differently colored ink.

A rotatable fountain roller is mounted on the press for rotation about a fountain axis. The fountain roller has a plurality of cylindrical fountain roller portions corresponding in number to the plurality of compartments. Each fountain roller portion has at least a portion of its outer circumferential surface in inking communication with the differently colored ink in a respective compartment. Two of the fountain roller portions are spaced apart along the fountain axis by a spacing or annular channel in which said at least one partition is received.

The invention further includes means for rotating the fountain roller to distribute the differently colored inks in adjacent relation axially separated by said spacing circumferentially along the outer circumferential surfaces of the respective fountain roller portions during rotation of the fountain roller. A rotatable transfer roller is mounted on the press for movement between a pick-up position in which the transfer roller is in inking engagement with, and rotated about a transfer axis by, the fountain roller to transfer the differently colored inks at said spacing along an outer circumferential surface of the transfer roller during rotation thereof, and an inking position in which the transfer roller laden with the differently colored inks is in inking engagement with the work surface to apply the differently colored inks thereto during movement of the die.

In further accordance with this invention, means are provided for moving the transfer roller between the pick-up and inking positions, and for pressing the transfer roller against the work surface with a pressure sufficient to cause the differently colored inks to flow in opposite directions along the transfer axis towards each other to apply the differently colored inks to the work surface at a distance smaller than said spacing.

Thus, differently colored inks can be applied to the work surface in a single movement of the transfer roller and at a closer spacing than heretofore. In the preferred embodiment, the axial spacing on the fountain and transfer rollers is less than 0.10 inches and is, preferably, 0.060 inches. The distance between the inks on the work surface can be made to be just touching or "effectively zero". This feature enables multicolor engravings on a single printed line, or series of lines.

The partition is preferably constituted of a material different from that of the fountain roller. The partition material is polyurethane, polypropylene, Teflon™, or like plastic material, or is a metal such as bronze. The partition is snugly received in the spacing and preferably is in sliding, wiping contact with the fountain roller portions.

The transfer roller has a resilient material at its outer circumferential surface. Preferably, the transfer roller is constituted of rubber when solvent-based inks are used, and of polyurethane when water-based inks are used. The resilient material yields when pressed against the engraved die surface in the inking position.

A plurality of partitions can be used to divide the fountain pan into the compartments. In some applications, up to six different inks and compartments are utilized. There is no cross contamination of differently colored inks due to the partitions.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
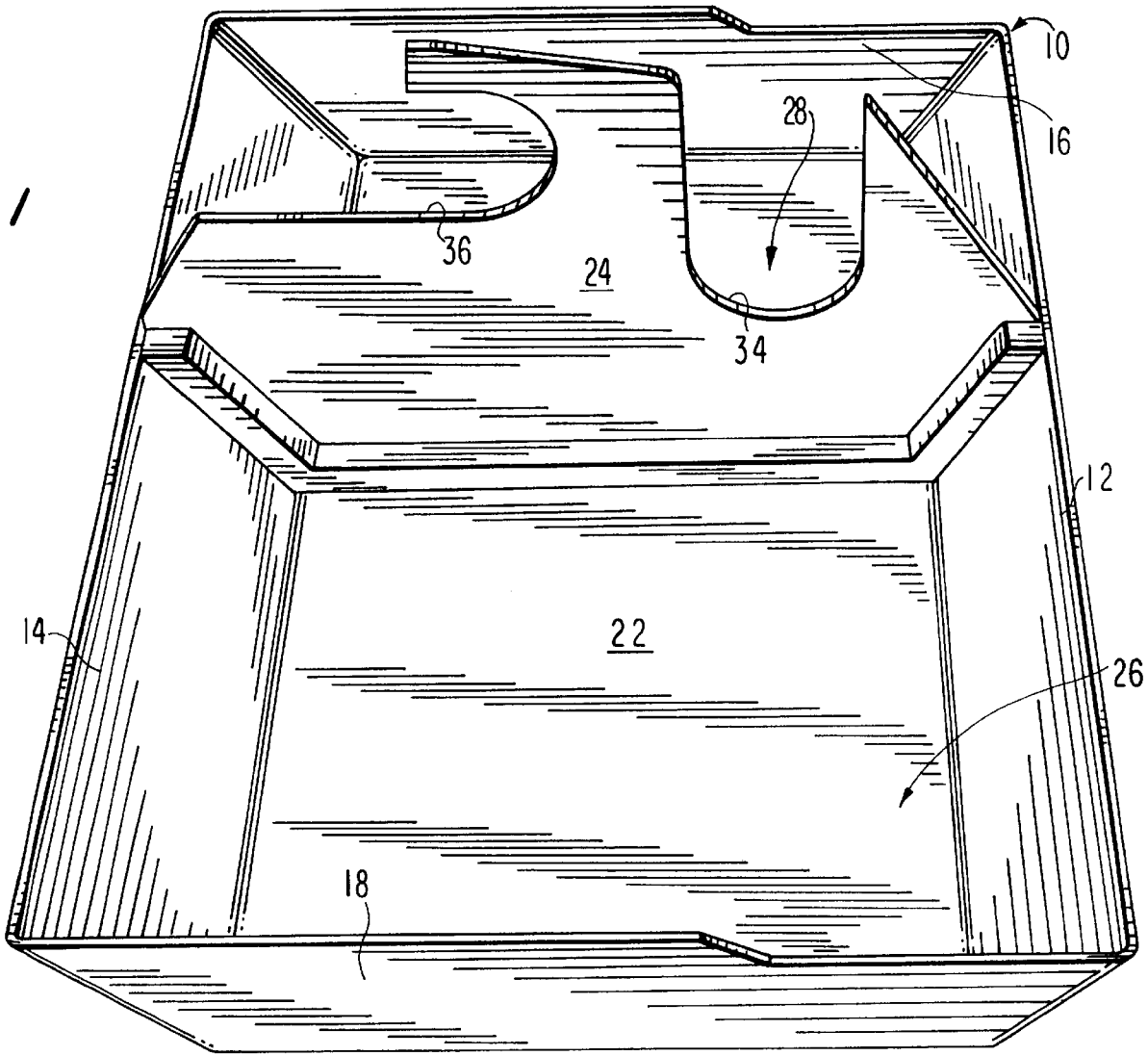
FIG. 1 is an overhead, perspective view of an ink fountain pan having two compartments for use in an ink transfer arrangement.

As shown in FIG. 1, an ink fountain pan 10 is shaped as a generally rectangular shallow tray having front 12 and rear 14 sloping walls, a pair of side walls 16, 18, and a bottom wall 22. A partition 24 divides the fountain pan 10 into a plurality of compartments 26, 28 for containing differently colored inks 30, 32. Although only a single partition is illustrated for forming two compartments with two inks, it will be understood that any number of partitions can be employed for dividing the fountain pan into more than two compartments. For example, five partitions can be employed to form six compartments for six inks of different colors.

Each partition 24 is generally planar and thin, i.e., less than 0.10 inches, and preferably on the order to 0.060 inches. Each partition 24 extends between the front and rear walls and lies in a plane generally parallel to the side walls. Each compartment may be equal in size, or unequal as illustrated. Each partition has an upwardly open slot 34 and a rearwardly open slot 36 whose purposes are described below.

Figure 2:
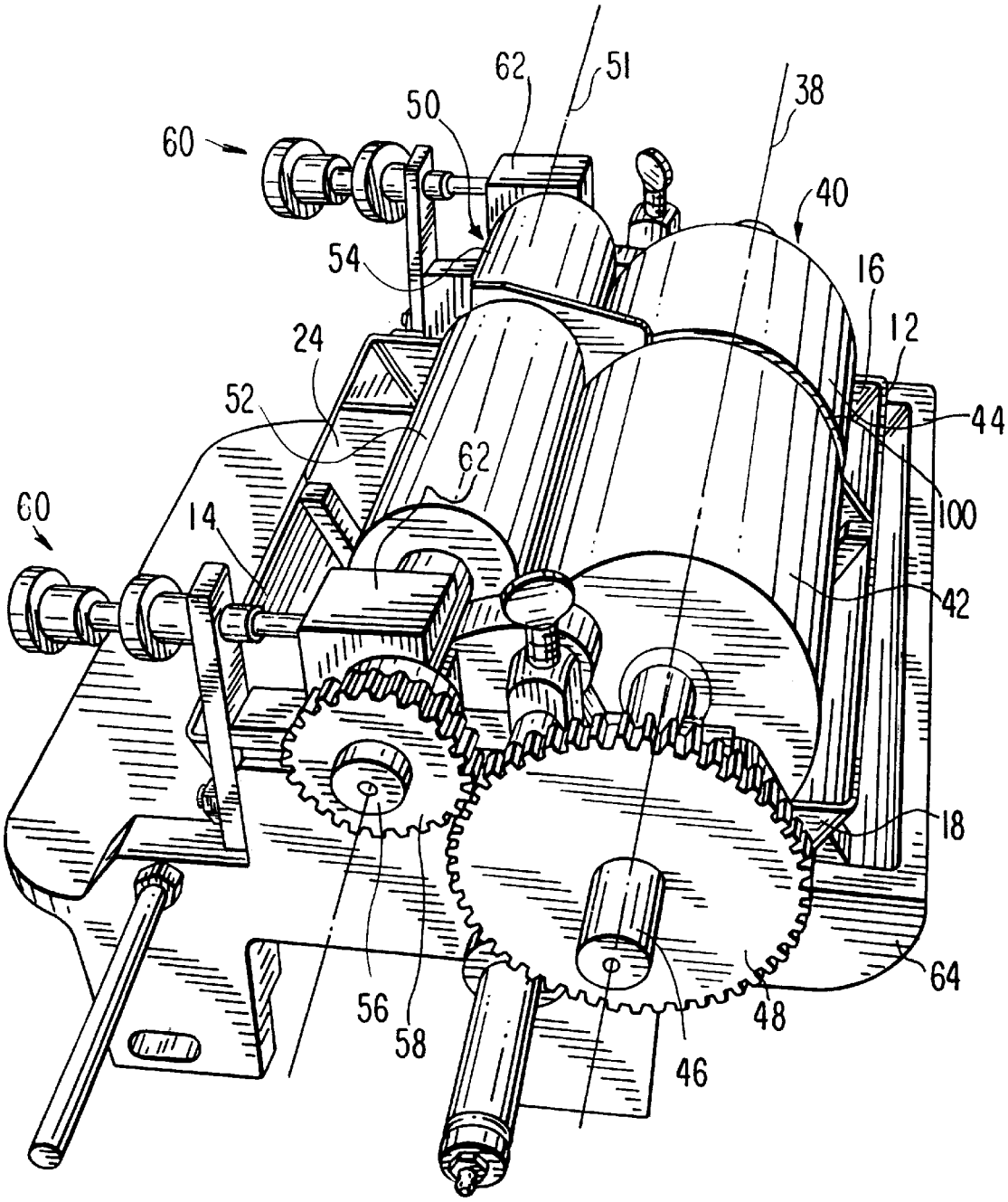
FIG. 2 is a side, perspective view of part of an ink transfer arrangement using the fountain pan of FIG. 1.
Figure 3:
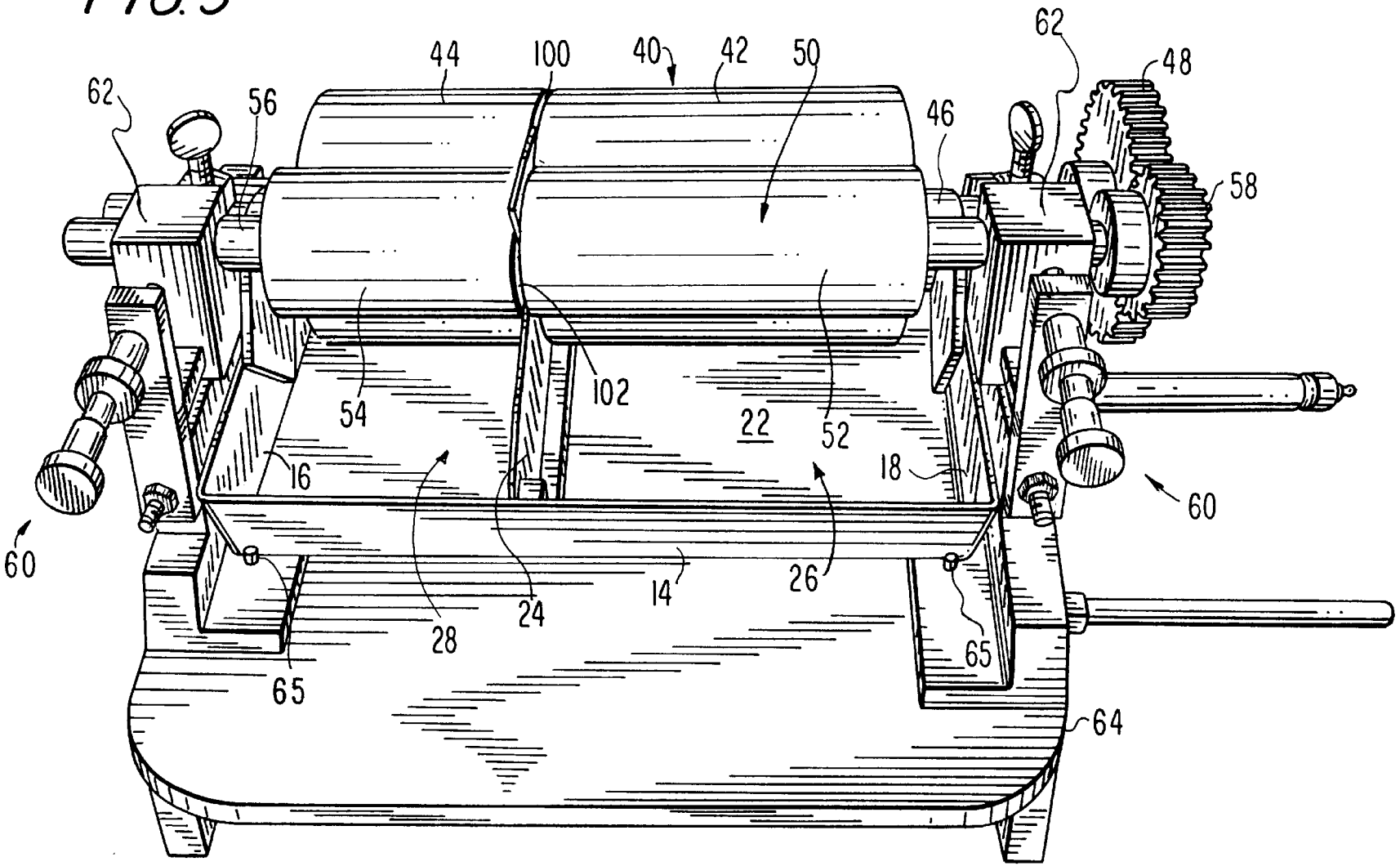
FIG. 3 is an end, perspective view of the arrangement of FIG. 2 as viewed from the left of FIG. 2 and mounted on a press bed.

As shown in FIG. 2, a rotatable fountain roller 40 of large diameter is mounted on the press for rotation about a fountain axis 38, and has a plurality of cylindrical fountain roller portions 42, 44 corresponding in number to the plurality of compartments. As shown, there are two fountain roller portions and two compartments. The fountain roller portions are mounted on a common shaft 46 and are spaced axially apart along the fountain axis 38 by a spacing or channel 100 in which the partition 24 is received, preferably in sliding, wiping engagement with facing end walls of the fountain roller portions.

Figure 7:
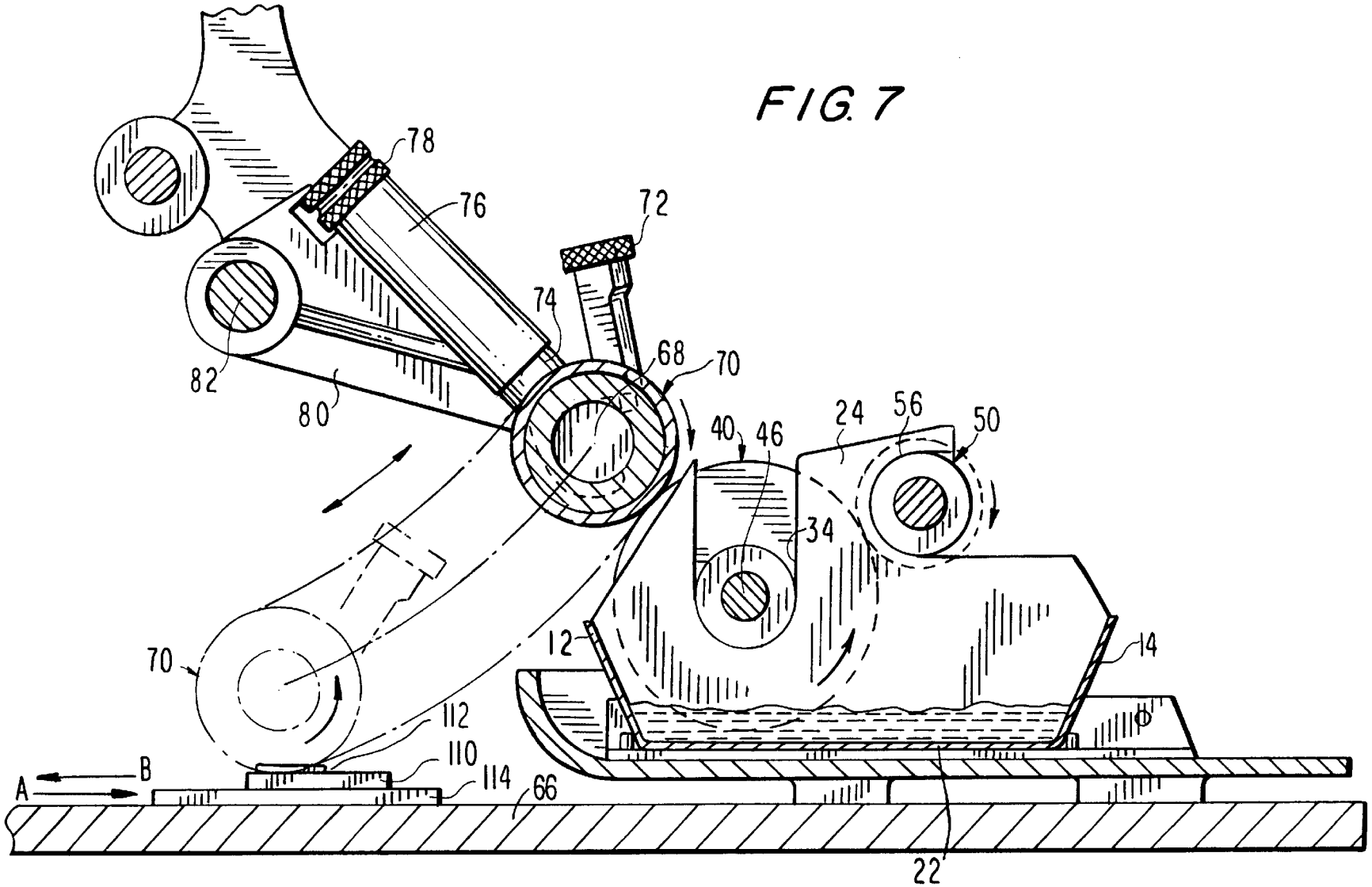
FIG. 7 is a side, sectional view of the arrangement of FIG. 6 during movement of the transfer roller.

FIG. 7 shows the receipt of the partition 24 in the spacing 100 after the fountain roller has been lowered from above into the slot 34 and journaled therein. FIG. 7 also shows that each fountain roller portion has at least a portion of its outer circumferential surface in inking communication with the differently colored ink in a respective compartment by being partially immersed in the supply of ink therein.

Also mounted on the shaft 46 is a drive gear 48 in driving engagement with a transmission (not shown) and a motor (not shown) of the press. The motor rotates the drive gear and, in turn, the fountain roller to distribute the differently colored inks in adjacent relation axially separated by the spacing 100 circumferentially along the outer circumferential surfaces of the respective fountain roller portions during rotation of the fountain roller. The ink layers around fountain roller portions 42, 44 are depicted in the drawings by speckling. The speckling on fountain roller portion 42 is shown denser than the speckling on fountain roller portion 44 to denote that the respective ink layers are constituted from the differently colored inks 30, 32.

A rotatable metering or doctor roller 50 of smaller diameter than the roller 40 is mounted on the press for rotation about a metering axis 51, and has a plurality of cylindrical metering roller portions 52, 54 corresponding in number to the plurality of fountain roller portions 42, 44. The metering roller portions are mounted on a common shaft 56 and are axially spaced apart along the metering axis by a spacing or channel 102 in which the partition 24 is also received, preferably in sliding, wiping engagement with facing end walls of the metering roller portions. Spacing 102 is equal in axial dimension to spacing 100, both being annular channels.

FIG. 7 shows the receipt of the partition 24 in the spacing 102 after the metering roller has been inserted from the rear horizontally into the slot 36 and journaled therein. FIG. 7 also shows that the metering roller 50 is elevated and behind the fountain roller 40. The metering and fountain rollers are tangentially adjacent each other and bound a radial gap whose size controls the thickness of the ink layers on the fountain roller portions to be uniform.

After the metering roller is journaled in the slot 36, a pair of adjustment assemblies 60 applies pressure against a corresponding pair of bearing blocks 62 to hold the metering roller in position.

A driven gear 58 on the shaft 56 meshes with the drive gear 48 and is driven by the same at a speed determined by the ratio of the teeth on the driven and drive gears. The combined pitch diameter of the gears is less than the combined diameter of the rollers, thereby enabling the rollers to be fully closed against each other. The fountain pan 10 is mounted on a frame 64 and is held in place by positioning pins 65. The frame 64 is, in turn, mounted on a bed 66 of a press. Roller 40 is mounted on the frame 64 by a pair of bearing blocks 67. Roller 50 is adjustably mounted for back-and-forth movement relative to the frame 64 by the adjustment assemblies 60 that employ vertical plates fixed to the frame 64.

A rotatable transfer roller 70 having a shaft 68 is mounted on the press for movement between a pick-up position shown in solid lines in FIG. 7 and an inking position shown in phantom lines in FIG. 7. The transfer roller 70 has a resilient material at its outer circumferential surface. For example, if the inks are solvent-based, then the transfer roller has an outer cylindrical covering made of rubber. If the inks are water-based, then the covering is preferably made of polyurethane. In both cases, the resilient material yields under pressure as described below, and automatically returns to its initial uncompressed state. By contrast, the fountain and metering rollers are made of metal such as stainless steel. The transfer roller can be of one piece or, as described below, can be made of a pair of transfer roller portions spaced axially apart along the shaft 68.

A pair of releasable clamps 72 fixedly hold opposite ends of the shaft 68. The clamps are situated at the ends of a pair of arms 74 that is slidably received in hollow sleeves 76 to a desired position. A pair of pressure adjusting nuts 78 is employed to fix the arms in the desired position relative to the sleeves. The sleeves 76 are mounted on, and are driven by, a pivot shaft 82 by the motor drive 84 of the press 80.

Figure 4:
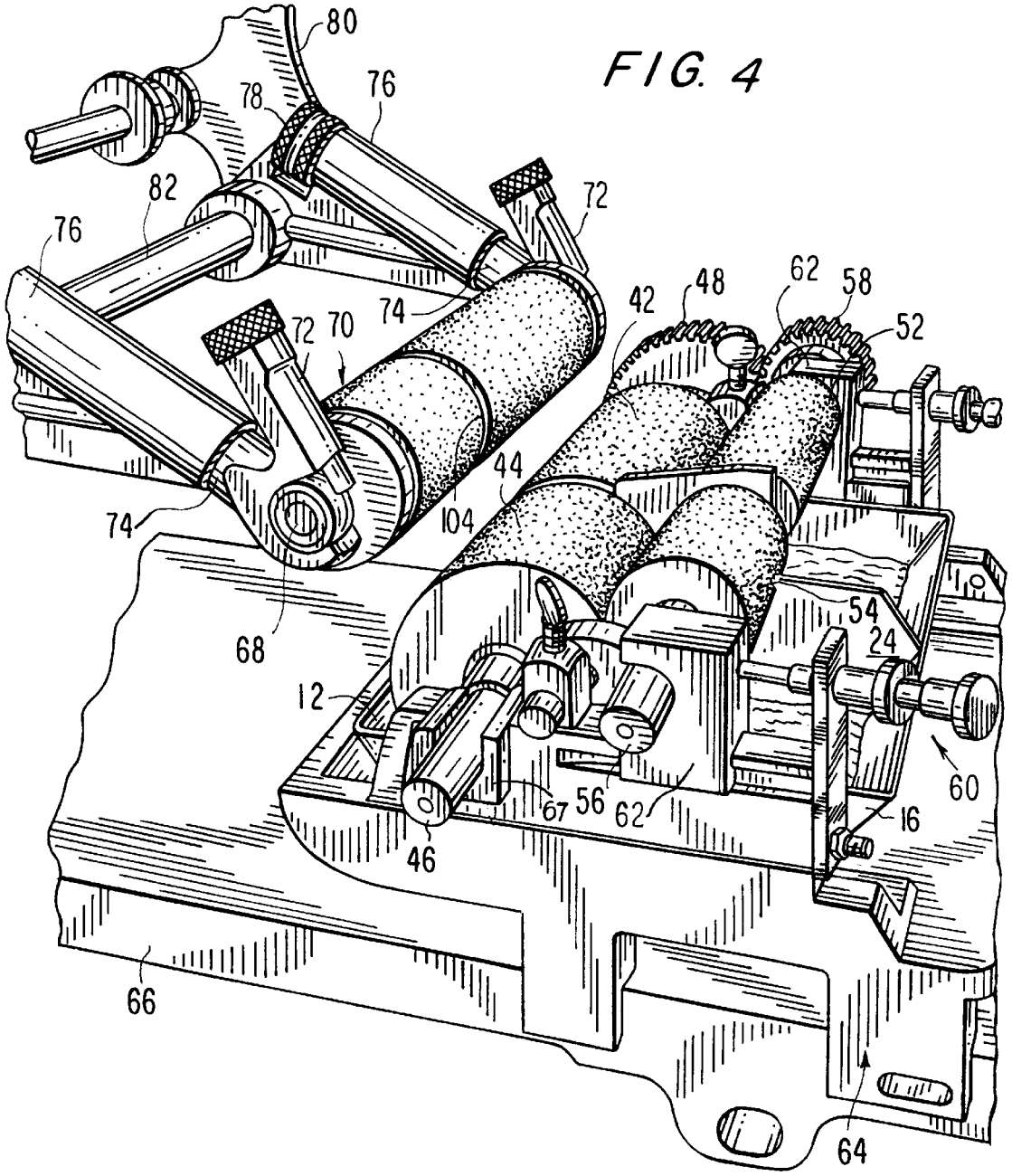
FIG. 4 is a side perspective view of the arrangement of FIG. 3 with a further part of the ink transfer arrangement.
Figure 5:
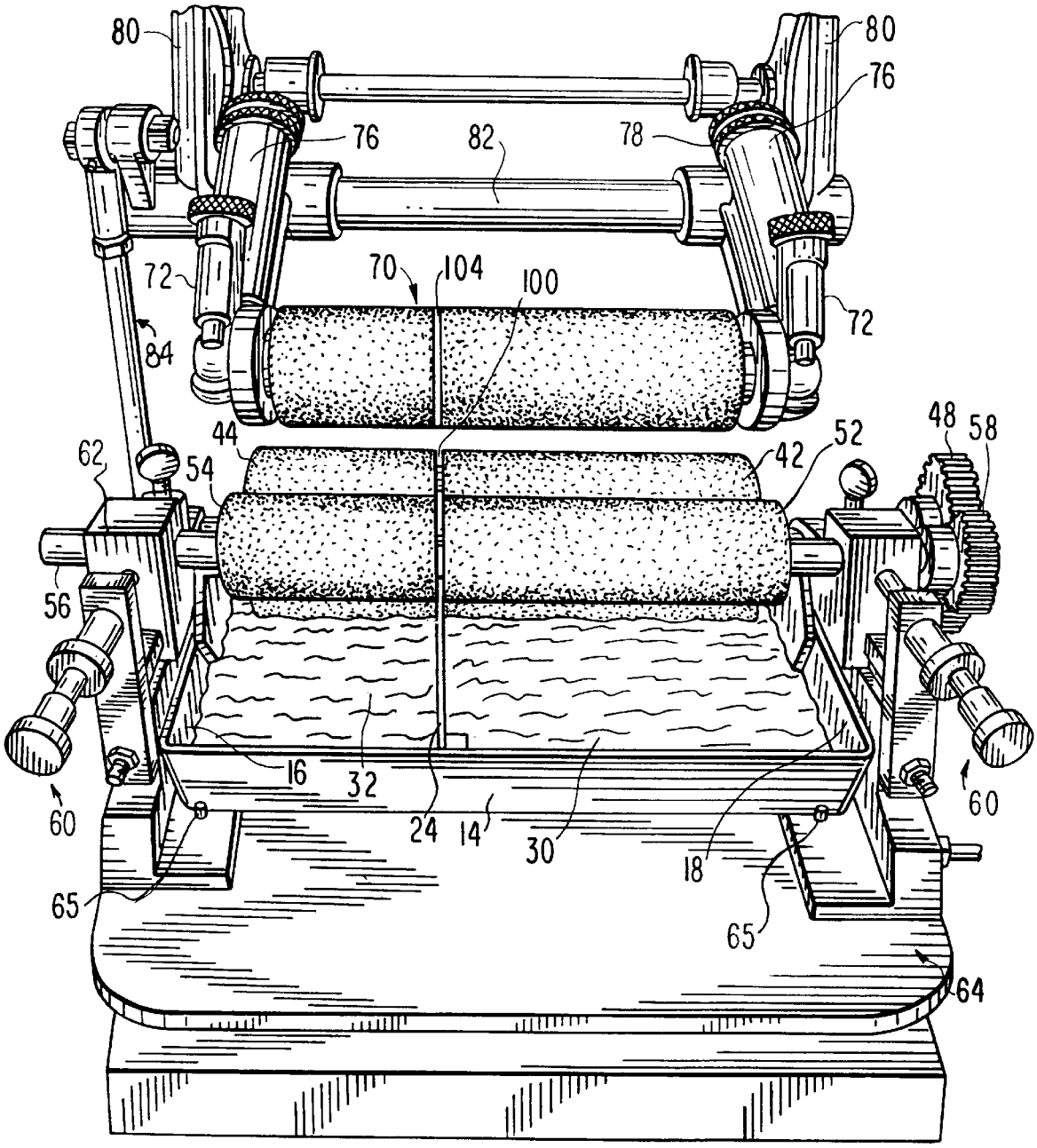
FIG. 5 is an end, overhead view of the arrangement of FIG. 4.
Figure 6:
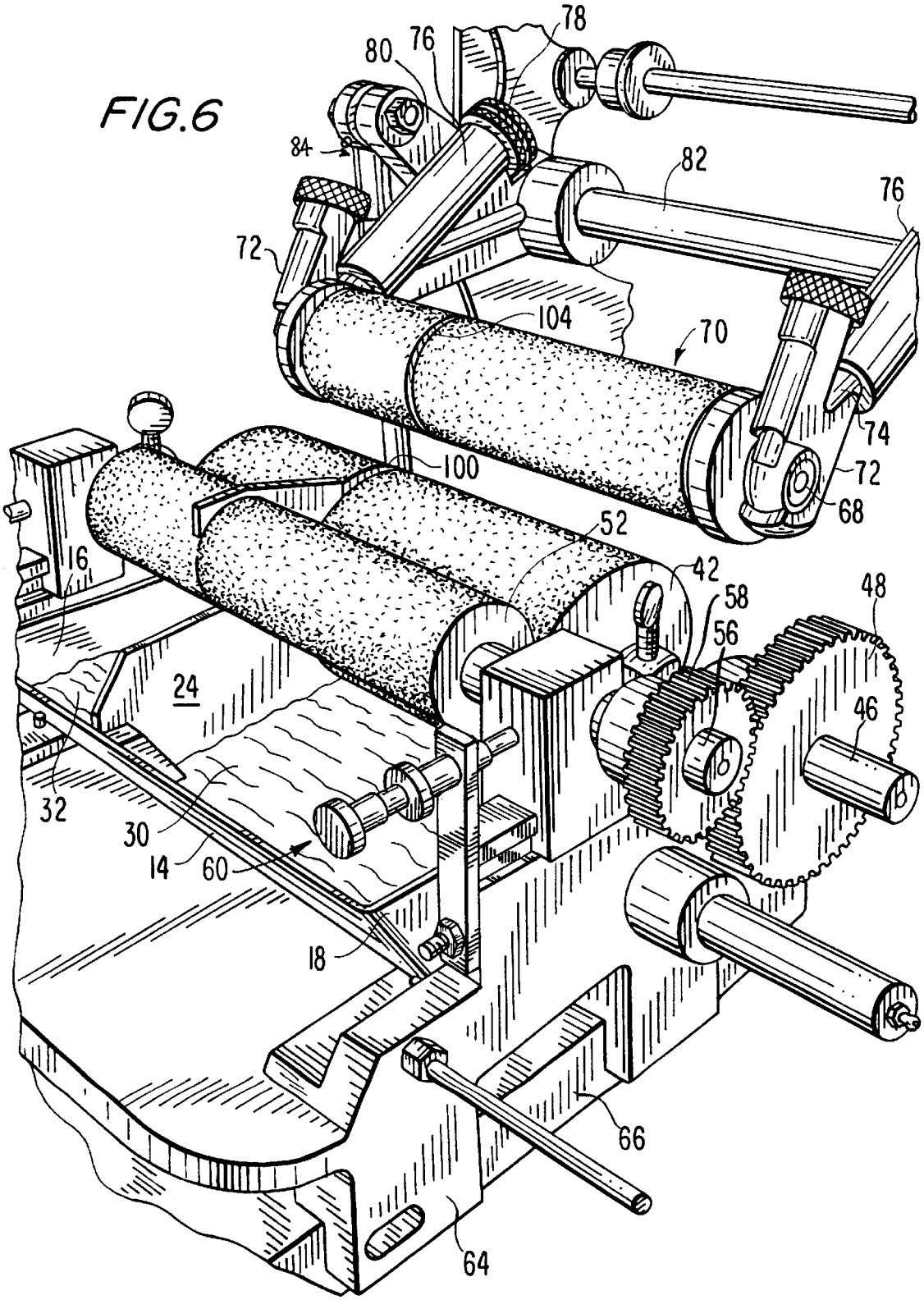
FIG. 6 is a side, perspective view of the arrangement of FIG. 5.

As shown in solid lines in FIG. 7, the arms 74 are extended and locked in a position so that the transfer roller 70 tangentially engages, and is in inking engagement with, the fountain roller 40 at little or no pressure to prevent ink cross contamination. The fountain roller 40 rotates the transfer roller 70 to transfer the differently colored inks from the fountain roller portions to the transfer roller along the entire circumference thereof and at a uniform ink thickness. The ink layers on the transfer roller 70, as well as on the metering roller 50, are shown by dense and sparse speckling as described above for the fountain roller. The ink layers on the transfer roller are also shown as being spaced axially apart by a spacing or channel 104 on the same order of magnitude as the spacing 100. In FIGS. 4–6, the transfer roller is moved away from the fountain roller to better view the ink layers on the transfer roller and the spacing between the ink layers.

Once the transfer roller is laden with ink, it is pivoted down to the inking position depicted in FIG. 7. After this downward pivoting movement, a die or plate 110 having an engraved, etched or work surface 112 and mounted on a die table 114 is moved in the direction of arrow A and then is moved in the opposite direction of arrow B, during which movement the work surface engages and rotates the transfer roller, thereby inking the work surface with the inks from the transfer roller. Once the die has cleared the transfer roller, the transfer roller is pivoted upwardly back to the pick-up position.

In the inking position, the transfer roller 70 is pressed against the work surface 112 with a pressure sufficient to cause the differently colored inks to flow in opposite directions along the shaft 68 towards each other. This pressure can be controlled by adjusting the lengths of the arms 74, or by affirmatively driving the transfer roller in a direction perpendicular to the work surface, or by selecting the resilient, yieldable characteristic of the covering of the transfer roller. The greater the pressure, the greater the flow of the differently colored inks towards each other and, in turn, the smaller the spacing between the differently colored inks on the work surface. The spacing on the work surface will be smaller than the spacing 100 or 104, and can be made to touch each other so that the spacing is zero or effectively zero. In some cases, it may be desirable for the inks to flow and actually overlap each other so that the spacing is, effectively, a negative number, thereby creating a controlled mixing of the colored inks.

As a result, differently colored inks can be applied to the engraved or etched die or plate surface and, in turn, to a document much closer than heretofore and during a single stroke or swing of the transfer roller.

Rather than the die being a flat intaglio plate that is linearly reciprocated back and forth, the engraved surface can be on a roller that is turned about an axis.

The term "inking engagement" as used herein is intended to signify that one component need not necessarily, but preferably does, directly contact another component to transfer ink thereto, inasmuch as a thin layer of ink is interposed therebetween.

In a modification to the above construction, the transfer roller 70 is not constituted of one-piece as described above, but instead, is divided into a plurality of transfer roller portions corresponding in number to the plurality of fountain roller portions and axially spaced apart along the shaft 68 by the spacing 104. An annular spacer can be inserted between the transfer roller portions to keep them apart. In this embodiment, which is currently the preferred one, the spacing 104 is actually slightly larger than the spacing 100, and is required to prevent the ink from being thrown off the fountain roller during operation.

It will be understood that each of the elements described above, or two or more together, also may find a useful application in other types of constructions differing from the types described above.

While the invention has been illustrated and described as embodied in a multicolor ink transfer arrangement and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. An ink transfer arrangement for transferring differently colored inks to a work surface of a movable component in a printing press, comprising:

a) an ink fountain pan mounted on the press, including at least one partition for dividing the fountain pan into a plurality of compartments each containing a differently colored ink;

b) a rotatable fountain roller mounted on the press for rotation about a fountain axis, the fountain roller having a plurality of cylindrical fountain roller portions corresponding in number to the plurality of compartments, each fountain roller portion having at least a portion of its outer circumferential surface in inking communication with the differently colored ink in a respective compartment, two of the fountain roller portions being spaced apart along the fountain axis by a spacing in which said at least one partition is received;

c) mean for rotating the fountain roller to distribute the differently colored inks in adjacent relation axially separated by said spacing circumferentially along the outer circumferential surfaces of the respective fountain roller portions during rotation of the fountain roller;

d) a rotatable transfer roller mounted on the press for movement between a pick-up position in which the transfer roller is in inking engagement with, and rotated about a transfer axis by, the fountain roller to transfer the differently colored inks at said spacing along an outer circumferential surface of the transfer roller during rotation thereof, and an inking position in which the transfer roller laden with the differently colored inks is in inking engagement with the work surface to apply the differently colored inks thereto during movement of the component; and e) means for moving the transfer roller between the pick-up and inking positions, and for pressing the transfer roller against the work surface with a pressure sufficient to cause the differently colored inks to flow in opposite directions along the transfer axis towards each other to apply the differently colored inks to the work surface at a distance smaller than said spacing.

2. The arrangement of claim 1, wherein said at least one partition is in sliding, wiping engagement with the fountain roller portions.

3. The arrangement of claim 2, wherein said at least one partition is constituted of a material different from that of the fountain roller.

4. The arrangement of claim 1; and further comprising a rotatable metering roller mounted on the press for rotation about a metering axis, the metering roller having a plurality of cylindrical metering roller portions corresponding in number to the plurality of the fountain roller portions, each metering roller portion being positioned at a radial gap relative to a respective fountain roller portion to control a thickness of each differently colored ink on the respective fountain roller portion.

5. The arrangement of claim 4, wherein said at least one partition extends into said gap and is in sliding, wiping engagement with the metering roller portions.

6. The arrangement of claim 1, wherein the transfer roller has a resilient material at its outer circumferential surface.

7. The arrangement of claim 1, wherein the moving means is operative for pivoting the transfer roller about a pivot axis between the pick-up and inking positions which are spaced angularly apart along an arcuate path.

8. The arrangement of claim 7, wherein the transfer roller has opposite end regions, and wherein the moving means includes a pair of swing arm assemblies connected to the end regions of the transfer roller.

9. The arrangement of claim 8, wherein each arm assembly includes an elongated hollow sleeve, an arm slidable along the sleeve to a selected position, and a fixing element for fixing the arm in the selected position.

10. The arrangement of claim 1, wherein said spacing is less than 0.10 of an inch.

11. A method of transferring differently colored inks to a work surface of a movable component in a printing press, comprising the steps of:

a) mounting an ink fountain pan on the press, including dividing the fountain pan into a plurality of compartments each containing a differently colored ink;

b) mounting a rotatable fountain roller on the press for rotation about a fountain axis, the fountain roller having a plurality of cylindrical fountain roller portions corresponding in number to the plurality of compartments, each fountain roller portion having at least a portion of its outer circumferential surface in inking communication with the differently colored ink in a respective compartment, two of the fountain roller portions being spaced apart along the fountain axis by a spacing;

c) rotating the fountain roller to distribute the differently colored inks in adjacent relation axially separated by said spacing circumferentially along the outer circumferential surfaces of the respective fountain roller portions during rotation of the fountain roller;

d) mounting a rotatable transfer roller on the press for movement between a pick-up position in which the transfer roller is in inking engagement with, and rotated about a transfer axis by, the fountain roller to transfer the differently colored inks at said spacing along an outer circumferential surface of the transfer roller during rotation thereof, and an inking position in which the transfer roller laden with the differently colored inks is in inking engagement with the work surface to apply the differently colored inks thereto during movement of the component; and e) moving the transfer roller between the pick-up and inking positions, and pressing the transfer roller against the work surface with a pressure sufficient to cause the differently colored inks to flow in opposite directions along the transfer axis towards each other to apply the differently colored inks to the work surface at a distance smaller than said spacing.

12. The method of claim 11; and further comprising the step of mounting a rotatable metering roller on the press for rotation about a metering axis, the metering roller having a plurality of cylindrical metering roller portions corresponding in number to the plurality of the fountain roller portions, each metering roller portion being positioned at a radial gap relative to a respective fountain roller portion to control a thickness of each differently colored ink on the respective fountain roller portion.

13. The method of claim 11, wherein the moving step is performed by pivoting the transfer roller about a pivot axis between the pick-up and inking positions which are spaced angularly apart along an arcuate path.

* * * * *